US010006612B2

(12) United States Patent
Ji et al.

(10) Patent No.: US 10,006,612 B2
(45) Date of Patent: Jun. 26, 2018

(54) LED LIGHTING ASSEMBLY STRUCTURE

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Feng Ji, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days. days.

(21) Appl. No.: 15/380,719

(22) Filed: Dec. 15, 2016

(65) Prior Publication Data

US 2017/0191640 A1 Jul. 6, 2017

(30) Foreign Application Priority Data

Dec. 31, 2015 (CN) ..... 2015 1 1029668

(51) Int. Cl.

| | |
|---|---|
| ***F21V 21/00*** | (2006.01) |
| ***F21V 15/015*** | (2006.01) |
| ***F21V 29/89*** | (2015.01) |
| ***F21K 9/272*** | (2016.01) |
| ***F21V 15/01*** | (2006.01) |
| ***F21V 17/12*** | (2006.01) |
| *F21S 4/28* | (2016.01) |

(52) U.S. Cl.

CPC ..... *F21V 15/015* (2013.01); *F21K 9/272* (2016.08); *F21V 15/01* (2013.01); *F21V 17/12* (2013.01); *F21V 29/89* (2015.01); *F21S 4/28* (2016.01); *F21V 15/013* (2013.01)

(58) Field of Classification Search

CPC ..... F21V 15/015; F21V 17/12

See application file for complete search history.

(56) References Cited

U.S. PATENT DOCUMENTS

2010/0201239 A1* 8/2010 Mostoller ..... F21S 8/031 313/1

* cited by examiner

*Primary Examiner* — Sean Gramling

(74) *Attorney, Agent, or Firm* — Wang Law Firm, Inc.

(57) ABSTRACT

An LED lighting assembly structure includes a lamp housing, and an end cap. The lamp housing includes at least one slot. The end cap includes a lug cap, at least one through-hole, and at least one reinforcing rib, and at least one fastener. The reinforcing rib and the through-hole are partially coincident with each other in a cross section perpendicular to the central axis of the through-hole. When the fastener is screwed into the through-hole and the slot, it may either cut into the reinforcing rib, or the reinforcing rib is pressed against the lug cap, or both the reinforcing rib is pressed against the lug cap and the fastener cuts into the reinforcing rib. As a result, the strength between the fastener and the lamp frame is improved, and it is possible to make the lamp house smaller and thinner, which is advantageous in reducing the volume of the entire lamp.

8 Claims, 3 Drawing Sheets

LED LIGHTING ASSEMBLY STRUCTURE

RELATED APPLICATION

This present application claims benefit of the Chinese Application, CN201511029668.X, filed on Dec. 31, 2015.

BACKGROUND

1. Technical Field

The present application relates to lighting equipments, and more particularly to an LED lighting assembly structure.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of LED lamps. With the LED lamps, especially the large-scale use of strip LED lamps, its rapid assembly and quality improvement is regarded as one of the effective ways to reduce costs.

Therefore, it is necessary to provide an LED lighting assembly structure which can be rapidly assembled and has high quality.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
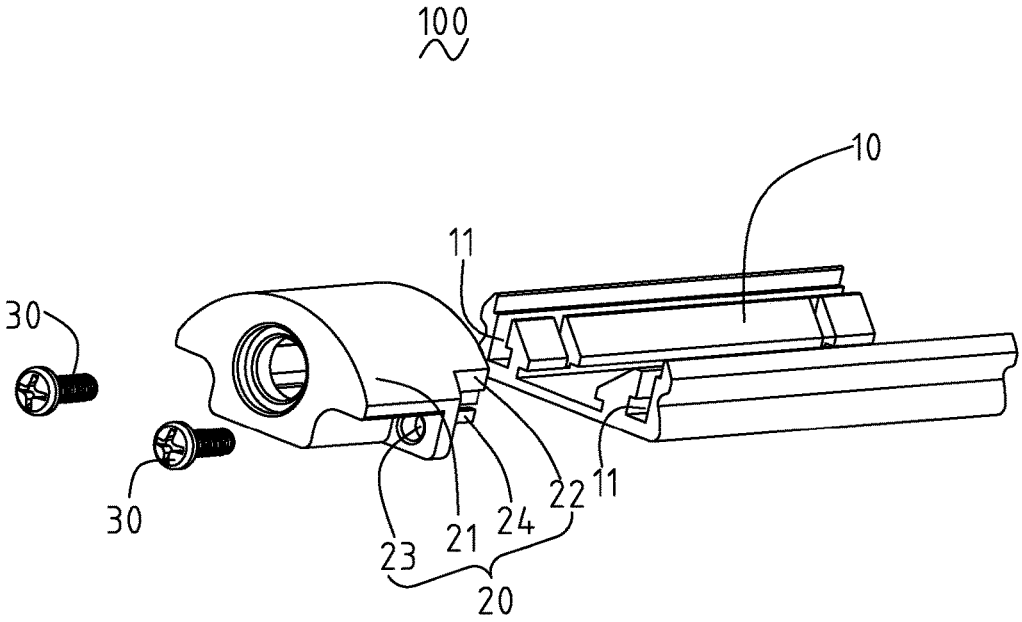
FIG. 1 is an exploded schematic view of a LED lighting assemble structure according to an embodiment.
Figure 2:
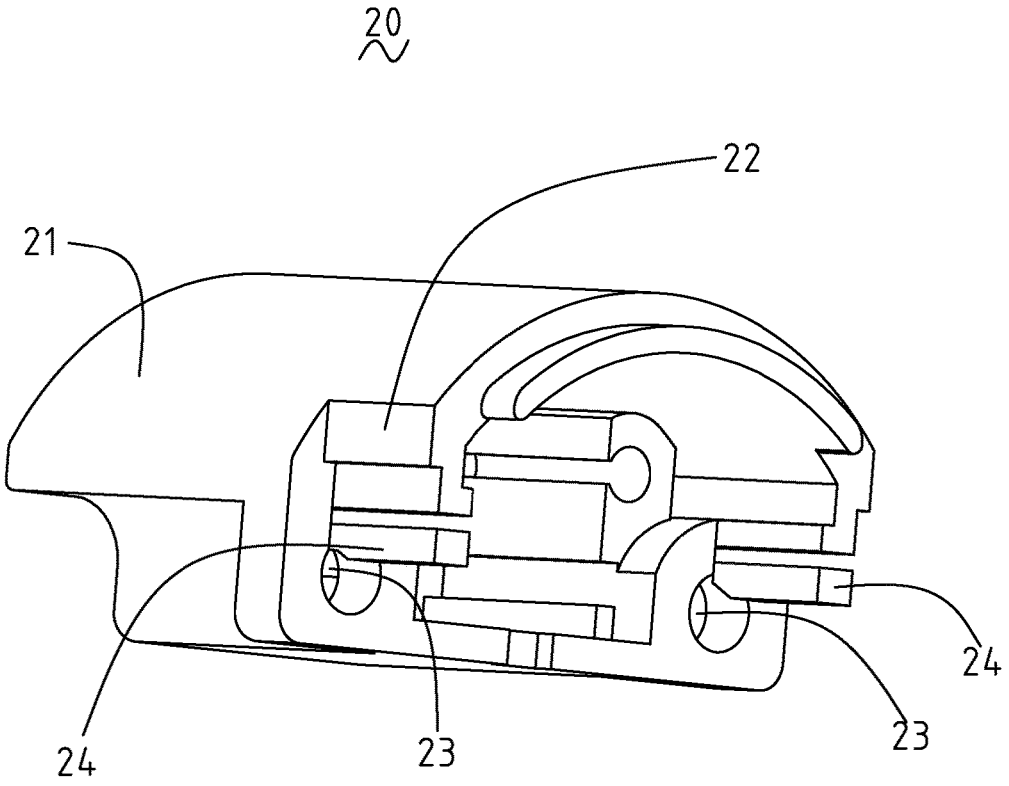
FIG. 2 is a schematic view of an end cap of the LED lighting assemble structure of FIG. 1.
Figure 3:
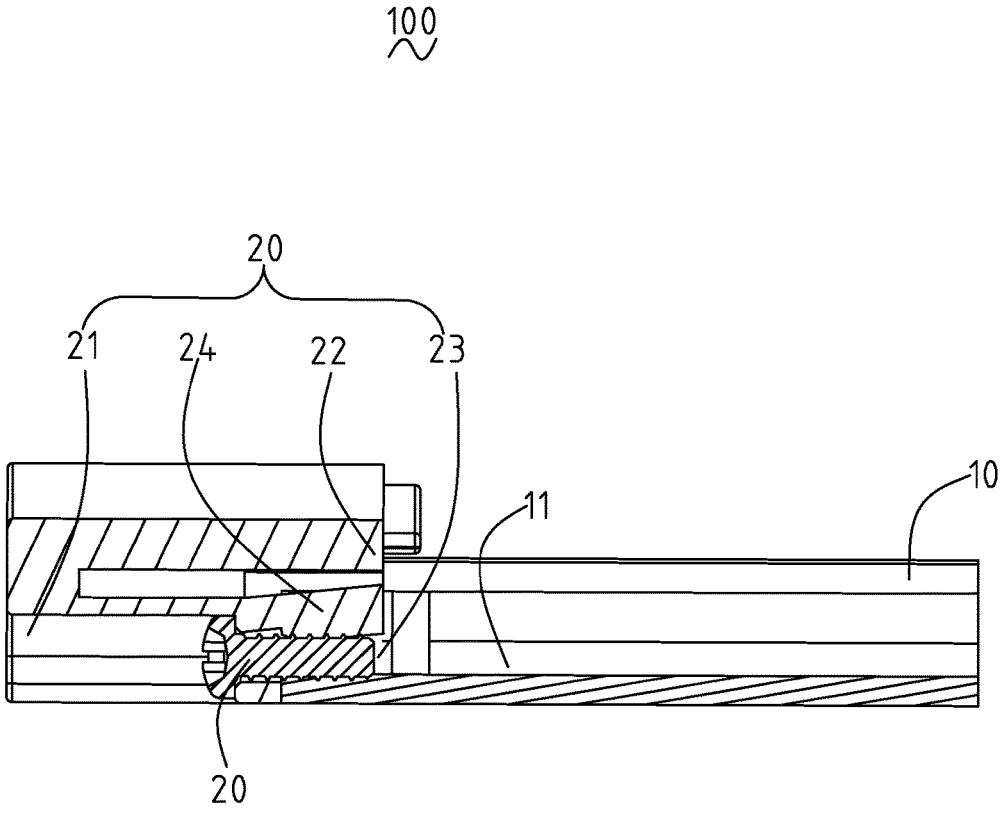
FIG. 3 is a cross section view of the LED lighting assemble structure of FIG. 1 taken along the line of A-A.

Referring to FIG. 1-FIG. 3, an LED lighting assembly structure 100 according to an embodiment are shown. The LED lighting assembly structure 100 includes a lamp housing 10, an end cap 20 interposed in the lamp housing 10, and at least one fastener 30 disposed in the lamp housing 10 and the end cap 20. It is of course understood that the LED lighting assembly structure 100 also includes other functional modules, such as a wire plug-in module, a circuit board, an LED chip module, and so on, which are not the subject of the present invention and will not be described in detail herein.

The lamp housing 10 may is of strip shape, and can be made of metal materials to facilitate heat dissipation of the entire lamp. In the present embodiment, the lamp housing 10 is of an elongated structure and is extruded and is made of aluminum alloy. The lamp housing 10 includes at least one slot 11 disposed therein. Typically, the lamp housing 10 is provided with two slots 11. The two slots 11 is configured not only to assemble the end cap 20 but also to mount a watertight seal, lampshade, or the like. In order to make the entire lamp small, such as very thin or very light, the wall thickness of the lamp housing 10 is usually very thin. Therefore, the parameter of the slot 11 is also small to achieve the above-purpose. Further, the diameter of the fastener 30, which is used to assemble the end cap 20, may have no large size because too much will damage the lamp housing 10 and too little will cause screw loose. In result, it makes that it is difficult to complete assembly or the product has a low quality.

The end cap 20 includes a body 21, a lug cap 22 extending from the body 21, at least one through-hole 23 opened on the body 21, and at least one reinforcing rib 24 provided between the through-hole 23 and the lug cap 22. The end cap 20 is made of plastic or resin materials. In order to avoid electric leakage and complicated structure, the end cap 20 is integrally molded and made of resin or plastic materials for ease of manufacturing and molding. The lug cap 22 extends along the axial direction of the lamp housing 10 and is mounted on the slot 11 for covering a gap among the end cap 20, the lamp housing 10, and the lampshade. In order to reinforce the strength of the assembled structure, the two free ends of the lug cap 22 along the axial direction of the lamp housing 10 are inserted into the opening of the slot 11. The specific shape of the lug cap 22 varies with that of the lamp housing 10 and the lampshade to engage the gap between the lamp housing 10 and the lampshade. The through-hole 23 is adapted to fit the fastener 30 and the axis of the through-hole 23 is coincident with the extension direction of the slot 11. In the present embodiment, since the lamp housing 10 has two the slots 11, the end cap 20 also has two through-hole 23 correspondingly. The diameter of the through-hole 23 should be equivalent to that of the fastener 30. The reinforcing ribs 24 extend from the body 21 along the extending direction of the lamp housing 10 and are arranged at the edges of the through-hole 23. In a cross section perpendicular to the central axis of the through-hole 23, the through hole 23 and the reinforcing ribs 2 interfere with each other. The interference of the through-hole 23 with the reinforcing ribs 24 means that the through-hole 23 are partially coincident with the reinforcing ribs 24 respectively in the direction along the central axis of the through-hole 23. The reinforcing ribs 24 may be seamlessly connected to the lug cap 22 or be spaced apart from the lug cap 22. In the present embodiment, the reinforcing ribs 24 are spaced apart from the lug cap 22 respectively.

The fastener 30 may be a screw, a plug, a stud, or the like. When the fastener 30 is threaded through the through-hole 23 and screwed into the slot 11 of the lamp housing 10, it can be cut into the through-hole 23, the slot 11, and the reinforcing ribs 24. When the fastener 30 is the plug and is inserted or threaded into the through-hole 23 and the slot 11, the reinforcing rib 24 will be pressed against the lug cap 22 by the fastener 30. In the present embodiment, the fastener 30 is a tapping screw. When the fastener 30 is threaded through the through-hole 23 and screwed into the slot 11, not only the fastener 30 cuts into the reinforcing rib 24 but also the reinforcing rib 24 is pressed against the lug cap 22 thereby.

During assembly, when the fastener 30 is screwed into the through-hole 23 and the slot 11 of the lamp housing 10, it may either cut into the reinforcing rib 24, or the reinforcing rib 24 is pressed against the lug cap 22, or both the reinforcing rib 24 is pressed against the lug cap 22 and the fastener 30 cuts into the reinforcing rib 24. As a result, the strength between the fastener 30 and the lamp frame 10 is improved, and it is possible to make the lamp house 10 smaller and thinner, which is advantageous in reducing the volume of the entire lamp.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED lighting assembly structure, comprising:

a lamp housing, the lamp housing comprising at least one slot;

an end cap interposed in the lamp housing, the end cap comprising a lug cap covering part of the slot, at least one through-hole mating with the slot, and at least one reinforcing rib disposed between the through-hole and the lug cap; and at least one fastener disposed in the lamp housing and the end cap, the reinforcing rib and the through-hole being partially coincident with each other in a cross section perpendicular to the central axis of the through-hole, wherein the at least one fastener cuts into the reinforcing ribs when the fastener is threaded through the through-hole and screwed into the slot.

2. The LED lighting assembly structure as claimed in claim 1, wherein the reinforcing ribs are seamlessly connected to the lug cap.

3. The LED lighting assembly structure as claimed in claim 1, wherein the reinforcing ribs are spaced apart from the lug cap.

4. The LED lighting assembly structure as claimed in claim 1, wherein the lamp housing is made of metal materials.

5. The LED lighting assembly structure as claimed in claim 1, wherein the end cap is made of resin or plastic materials.

6. The LED lighting assembly structure as claimed in claim 1, wherein the two free ends of the lug cap are inserted into the opening of the slot.

7. The LED lighting assembly structure as claimed in claim 1, wherein the reinforcing rib is pressed against the lug cap by the fastener when the fastener is threaded through the through-hole and screwed into the slot.

8. The LED lighting assembly structure as claimed in claim 1, wherein when the fastener is threaded through the through-hole and screwed into the slot, not only the fastener cuts into the reinforcing rib but also the reinforcing rib is pressed against the lug cap by the fastener.

* * * * *